United States Patent [19]

Stephenson

[11] 4,350,100

[45] Sep. 21, 1982

[54] AIR INFILTRATION AND MIXING DEVICE

[75] Inventor: Robert G. Stephenson, Panania, Australia

[73] Assignee: James Howden Australia Pty. Limited, Australia

[21] Appl. No.: 204,935

[22] Filed: Nov. 7, 1980

[30] Foreign Application Priority Data

Nov. 13, 1979 [AU] Australia ..... PE1300

[51] Int. Cl.[3] ..... F23J 15/00

[52] U.S. Cl. ..... 110/203; 98/38 A; 98/38 B; 110/185

[58] Field of Search ..... 110/160, 162, 185, 190, 110/203, 216, 217, 345; 98/38 R, 38 A, 38 B, 38 C

[56] References Cited

U.S. PATENT DOCUMENTS

| | | | |
|---|---|---|---|
| 517,793 | 4/1894 | Cottier | 110/160 X |
| 3,068,812 | 11/1962 | Hemeon | 110/190 X |
| 3,527,177 | 9/1970 | LaRue | 110/190 X |
| 3,837,302 | 9/1974 | Berjier | 110/190 |
| 3,917,239 | 11/1975 | Rhinehart | 110/216 X |

FOREIGN PATENT DOCUMENTS

| | | | |
|---|---|---|---|
| 46-13072 | 4/1971 | Japan | 98/38 B |

OTHER PUBLICATIONS

H. J. White, "Resistivity Problems in Electrostatic Precipitation", *Journal of the Air Pollution Control Association,* vol. 24, No. 4, Apr. 1974, pp. 314–338.

*Primary Examiner*—Albert J. Makay
*Assistant Examiner*—Harold Joyce

[57] ABSTRACT

An air infiltration and mixing device for introducing cool air into a duct, such as an exhaust duct from a power generation boiler, carrying a gas at an elevated temperature comprising a first duct carrying the gas at an elevated temperature and a plurality of further ducts, of significantly smaller cross sectional area than the first duct, extending into the first duct through a side wall thereof in a direction transversely of the longitudinal axis of the first duct. Each further duct having an aperture at its end within the first duct and facing in a downstream direction, the other end of each of the further ducts having an opening adapted to communicate with a source of cool air.

5 Claims, 1 Drawing Figure

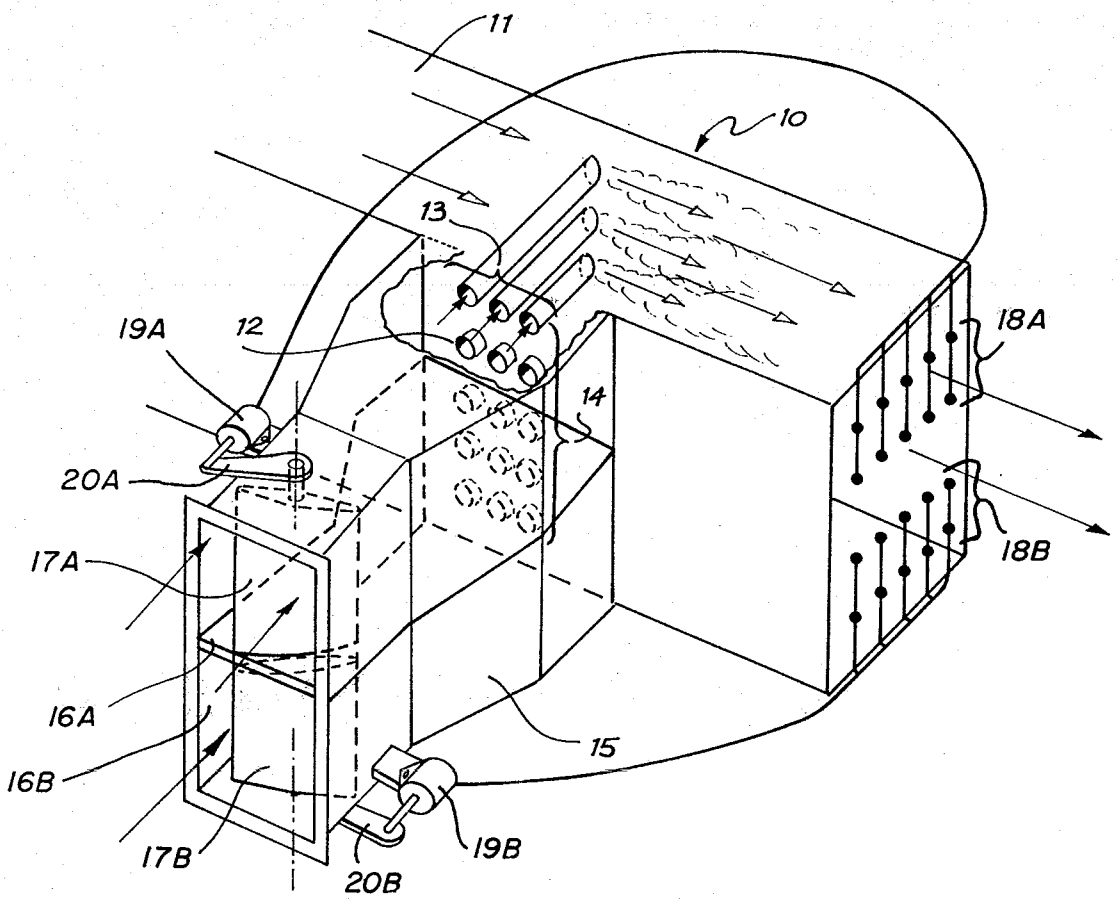
10
11
12
13
14
15
16A
16B
17A
17B
18A
18B
19A
19B
20A
20B

AIR INFILTRATION AND MIXING DEVICE

The present invention relates to an air infiltration and mixing device and more particularly to such a device adapted to facilitate the infiltration of cooling air into a duct carrying a gas at an elevated temperature.

Modern air pollution laws require that gas exhausts from boilers and the like be cleaned before being discharged to the atmosphere. One method proposed for cleaning such gas streams is to pass the gas stream through a fabric filter and to thereby remove particulate matter from the gas stream. A problem which has been encountered is that some filter fabrics can be damaged by excessive exhaust gas temperatures. The present invention provides an air infiltration and mixing device adapted to allow the admission of air into such an exhaust gas stream to cool it prior to its being passed through a fabric filter.

The present invention consists in an air infiltration and mixing device comprising a first duct adapted to carry a gas at an elevated temperature and a plurality of further ducts, each of significantly smaller cross sectional area than the first duct, extending into the first duct through a side wall thereof, the further ducts each extending transversely of the longitudinal axis of the first duct and each further duct having an aperture at or adjacent its free end opening substantially in the down stream direction of the first duct, the other end of each of the further ducts having an opening adapted to communicate with a source of air at a temperature lower than that of the said gas to be conveyed through the first duct.

In a preferred embodiment of the invention the opening in the said other end of each further duct communicates with an inlet box which itself communicates with the atmosphere through an aperture which is fitted with a damper. The damper is preferably fitted with an actuator which is controlled by a grid of thermocouples located in the first duct downstram of the further ducts. In this manner the amount of cooling air admitted can be kept to the minimum sufficient to maintain the gas temperature in the first duct at a level below that at which the filter fabric is damaged.

The further ducts are preferably arranged in rows parallel to the direction of the flow of the gas stream. The upstream duct extending further into the first duct than the next downstream one of the further ducts which in turn extends further into the first duct than next downstream one of the further ducts and so on. The further ducts are preferably also arranged in columns normal to the direction of flow of the gas stream such that the further ducts are spaced out in a grid like pattern to ensure even distribution and mixing of the infiltrated air.

The end of the further ducts within the first duct are preferably chamfered off at an angle, preferably 45°, to the direction of flow of the gas stream and facing downstream. The gas flowing down the first duct creates a zone of low pressure on the downstream side of the further ducts which causes air to be drawn into the first duct through the further ducts by a venturi effect.

A number of air infiltration and mixing devices according to the present invention can be installed in parallel so that various sections of the first duct can be controlled individually. Such an arrangement is advantageous in view of the considerable temperature stratification which can occur in hot gas streams, as it further minimises the amount of cooling air admitted to the first duct.

The drawing FIGURE shows a partly cut-away perspective view of the preferred air infiltration and mixing device.

The air infiltration and mixing device 10 comprises a first duct 11 adapted to carry a heated gas stream from a gas heater, such as a boiler, to a fabric filter and an array of further ducts 12 which enter the first duct 11 at right angles through a side wall of the first duct 11.

The further ducts 12 are arranged in a grid array made up of a series of rows 13 and a series of columns 14. All of the further ducts 12 are chamfered off in a downstream direction at 45° to the direction of flow of the gas stream in the first duct 11. The further ducts 12 in the furthest upstream column 14 project further into the first duct 11 than do those of the middle column 14 which in turn project further into the first duct 11 than do those of the furthest downstream duct. By such an array and positioning of the further ducts a uniform infiltration of the air into the first duct 11 is achieved.

The ends of the further ducts 12 distal to the first duct 11 open into an inlet box 15 which in turn communicates with the ambient air through apertures 16A and 16B controlled by dampers 17A and 17B, respectively. Thus, parallel air infiltration and mixing devices are formed whereby upper and lower sections respectively of the first duct 11 are controlled individually. The opening and closing of Damper 17A is controlled by crank arm 20A which is connected to and acted upon by solenoid 19A. The solenoid 19A is connected to a grid of thermocouples 18A located in the upper half of the first duct 11 downstream of the air infiltration and mixing device as shown in the drawing to thereby cause actuation of crank arm 20A and rotate the damper 17A and thereby control the amount of air flowing through the aperture 16A. Similarly, crank arm 20B is connected with damper 17B and movable by solenoid 19B connected to a grid of thermocouples 18B located in the lower half of the first duct 11 downstream of the air infiltration and mixing device as shown in the drawing to rotate the damper 17B so as to control the air flowing through the aperture 16B.

As hot gas passes down the first duct 11 air will be drawn in through apertures 16A and 16B respectively and further ducts 12 due to the reduced pressure created on the downstream side of the further ducts. Natural turbulence will cause the infiltrated air to mix with the heated gas stream thereby cooling it down.

I claim:

1. An air infiltration and mixing device comprising a first duct adapted to carry a gas at an elevated temperature and a plurality of further ducts, each of significantly smaller cross sectional area than the first duct, extending into the first duct through a side wall thereof, the further ducts each extending transversely of the longitudinal axis of the first duct and each further duct having an aperture at or adjacent its free end opening substantially in a downstream direction of the first duct, the other end of each of the further ducts having an opening adapted to communicate with a source of air at a temperature lower than that of the said gas to be conveyed through the first duct, the plurality of said further ducts being divided into at least two arrays of further ducts each of which arrays communicates with the said air source through a variable aperture damper and the further ducts in each array opening into a discrete zone of the cross sectional area of the first duct, at least two grids of the thermocouples located in the first duct downstream of the further ducts, each grid being disposed within a zone in the first duct corresponding to one of the discrete zones into which one of the arrays of further ducts opens, and actuator means to open and close each of the dampers individually in accordance with a signal received from the corresponding grid of thermocouples.

2. An air infiltration and mixing device as claimed in claim 1, in which the opening in the said other end of the further ducts communicate with an inlet box which itself communicates with the atmosphere through apertures which are fitted with said dampers.

3. An air infiltration and mixing device as claimed in claim 1 in which the further ducts are arranged in rows parallel to the direction of the flow of the gas stream, each further duct extending further into the first duct than its next adjacent duct in a downstream direction.

4. An air infiltration and mixing device as claimed in claim 3 in which the further ducts are further arranged in columns normal to the direction of flow of the gas stream.

5. An air infiltration and mixing device as claimed in claim 1 in which the aperture at the end of each further duct is formed by chamfering off the free end of each further duct at an angle to the direction of flow of the gas stream and facing downstream.

* * * * *